United States Patent [19]

Finken

[11] 4,431,998

[45] Feb. 14, 1984

[54] CIRCULARLY POLARIZED HEMISPHERIC COVERAGE FLUSH ANTENNA

[75] Inventor: Kenneth R. Finken, Indialantic, Fla.

[73] Assignee: Harris Corporation, Melbourne, Fla.

[21] Appl. No.: 149,548

[22] Filed: May 13, 1980

[51] Int. Cl.[3] ..... H01Q 21/26

[52] U.S. Cl. ..... 343/797; 343/720

[58] Field of Search ..... 343/700 MS, 797, 854, 343/705, 708, 846

[56] References Cited

U.S. PATENT DOCUMENTS

| | | | |
|---|---|---|---|
| 3,718,935 | 2/1973 | Ranghelli et al. | 343/797 |
| 4,042,935 | 8/1977 | Ajioka et al. | 343/797 |
| 4,157,548 | 6/1979 | Kaloi | 343/700 MS |

*Primary Examiner*—David K. Moore

*Attorney, Agent, or Firm*—Antonelli, Terry 6 Wands

[57] ABSTRACT

An antenna configuration capable of providing either shaped conical or uniform hemispheric coverage to circularly polarized signals from a very thin or flush mounted radiation structure. For this purpose, the antenna is configured of an array of (N=three or more) radiation elements fed in phase rotation (i.e. 360°/N phase difference between elements) to provide circular polarization. These elements may be short asymmetrically top loaded stubs, unbalanced slots, "L" type stubs, "U" shaped slots or other types of unbalanced elements which provide null free coverage in a hemisphere. The shape of these elements and their position in the array control the desired shaping of the antenna pattern.

The antenna elements are provided on a first printed circuit board that is spaced apart by a thin dielectric spacer from an impedance matching/phasing network such as from 90° and 180° hybrid networks formed on a second printed circuit board. The ratio of zenith (or nadir) to horizon signal is controlled by the location of vertical feed wires that extend from the hybrid-containing circuit board through the spacer to the radiation elements, and the degree of unbalance of the radiation elements themselves.

Assembly of the components of each antenna structure is accomplished by mounting screws that extend from one printed circuit board through the thin dielectric spacer to the other board. The resulting thin structure permits conformal mounting to curved surfaces such as an aircraft fuselage; if desired, however, the antenna may be mounted in a recess below the surface of the aircraft to thereby provide a completely flush mounting arrangement.

14 Claims, 6 Drawing Figures

CIRCULARLY POLARIZED HEMISPHERIC COVERAGE FLUSH ANTENNA

FIELD OF THE INVENTION

The present invention relates generally to radio antennas and, more particularly, to an extremely compact airborne antenna for providing shaped conical or uniform hemispheric coverage to circularly polarized signals.

BACKGROUND OF THE INVENTION

In airborne communication environments, such as aircraft or satellite based systems, radio signal transmission/reception capability over a substantial terrestrial area is required. For example, in a satellite, the extent of terrestrial coverage is of shaped conical configuration substantially bounded by lines tangential to the surface of the earth and intersecting the satellite. For lower altitude aircraft radio coverage extends hemispherically from the aircraft to the horizon. Antennas located near the surface of the earth which communicate with high flying aircraft or satellites of undetermined location also require hemispherical coverage. In any of these environments, a requirement for intended hemispherical radio coverage is a signal transmission scheme that makes available more signal at elevation angles near the horizon because of the greater distance and transmission loss. In addition, and it is especially true for antennas mounted on high performance aircraft, the physical size and shape of the antenna impact directly on its utility in the environment. Ideally, the antenna should not only provide full hemispheric coverage with the desired increase in gain at near horizon elevation angles, but should also be rugged, light weight and be of low drag configuration, and thereby readily acceptable for mounting on high performance aircraft.

Prior art approaches to provide hemispherical antenna coverage have included turnstile and crossed-slot structures, as well as a combination of those two configurations, as exemplified by the multielement structure detailed in the U.S. patent to Griffee, et al., No. 3,811,127. As described in this patent, while a crossed-slot antenna presents a minimum height profile when mounted to the fuselage of the aircraft, in order to be satisfactorily broadband, it becomes too large in horizontal displacement for fuselage mounting. The turnstile approach suffers from maximum vertical height limitations, thereby making it too large for satisfactory mounting on modern jet aircraft.

The patentees' approach is to combine the turnstile and crossed-slot configuration in an effort to achieve broadband operation and still make the size of the antenna compatible with aircraft mounting limitations. However, the Griffee, et al. configuration must still be fairly large in order to obtain the broadband performance intended and the patentees do not contemplate adjustability or control of the shape of the radiation pattern.

Of course, reduced-size antenna structures, per se, such as those of microstrip configuration, have been proposed for airborne applications. Examples of such antennas are described in the U.S. patents to Kaloi, Nos. 4,125,838 and 4,151,530 and the U.S. patent to Van Atta, et al., No. 3,680,142. However, none of these structures provides a broad antenna pattern required for hemispherical coverage; nor do they provide control over the radiation pattern shape, in particular the ratio of zenith-to-horizon signal.

SUMMARY OF THE INVENTION

In accordance with the present invention there has been developed a new and improved antenna configuration that is capable of providing either shaped conical or uniform hemispheric coverage to circularly polarized signals from a very thin or flush mounted radiation structure. For this purpose, the antenna is configured of an array of (N=three or more) radiation elements fed in phase rotation (i.e. 360°/N phase difference between elements) to provide circular polarization. These elements may be short asymmetrically top loaded stubs, unbalanced slots, "L" type stubs, "U" shaped slots or other types of unbalanced elements which provide null free coverage in a hemisphere. The shape of these elements and their position in the array control the desired shaping of the antenna pattern.

In accordance with a first embodiment of the invention operating over two frequency bands, four printed circuit-formed antenna elements are provided on a first printed circuit board that is spaced apart via a thin dielectric spacer from 90° and 180° hybrid networks formed on a second printed circuit board. The ratio of zenith (or nadir) to horizon signal is controlled by the location of vertical feed wires that extend from the hybrid-containing circuit board through the spacer to the radiation elements, and the degree of unbalance of the radiation elements themselves.

In a second embodiment, two sets (for two respective frequencies) of three radiation elements are provided on a first printed circuit board, the individual elements of each set being asymmetrical top loaded elements. Impedance matching and phase delay lines at each frequency are incorporated on the second printed circuit board, from which vertical wires extend through a dielectric spacer to the elements on the first printed circuit board.

Assembly of the components of each antenna structure is accomplished by mounting screws that extend from one printed circuit board through the thin dielectric spacer to the other board. The resulting thin structure permits conformal mounting to curved surfaces such as an aircraft fuselage; if desired, however, the antenna may be mounted in a recess below the surface of the aircraft to thereby provide a completely flush mounting arrangement.

Advantageously, with this type of antenna configuration, by way of which pattern shaping is readily and easily controlled, the signal response of the antenna affords several db more gain at near horizon elevation angles than more conventional antennas having a zenith or nadir directed beam, and still provides adequate coverage at zenith or nadir.

DETAILED DESCRIPTION

Figure 1:
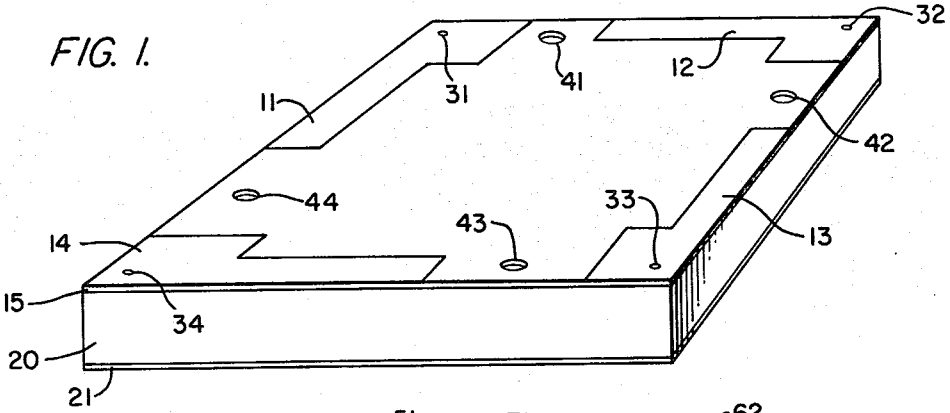
FIG. 1 depicts an embodiment of a four element circularly polarized hemispheric coverage antenna having L-shaped stubs.

Referring now to FIG. 1 of the drawings there is shown a first embodiment of the invention configured of a pair of square-shaped printed circuit boards 15 and 21 disposed on opposite surfaces (top and bottom as viewed in FIG. 1) of a thin square dielectric spacer element 20. Printed circuit board 15 contains a set of four separated L-shaped areas 11–14 of metallic film (e.g. copper) arranged at the corners of the board with the long and short legs of each "L" shape colinear with respective edges of the corner. Mounting holes 41–44 extend through board 15 as well as spacer 20 and lower printed circuit board 21 for receiving suitable mounting screws by way of which the two boards 15 and 21 are held together with spacer 21 sandwiched between the boards in the antenna's assembled configuration.

Figure 5:
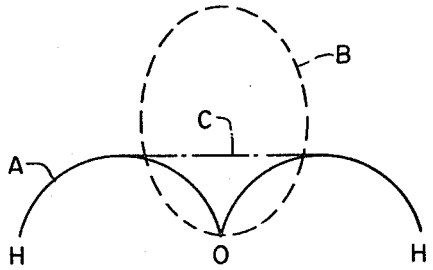
FIG. 5 shows an exemplary equivalent antenna coverage profile that may be obtained in accordance with the present invention.

Lower printed circuit board 21 contains 90° and 180° hybrids printed on its surface that faces the bottom of dielectric spacer 20 from which feed wires extend through spacer 20 and to connection holes 31–34 in upper printed circuit board 15. As shown in FIG. 1 these connection holes or points of electrical connection of the vertical feed wires to the antenna elements near one end of the antenna elements effectively form an L-shaped stub. With this unbalanced antenna configuration and the feeding of the four antenna elements in phase rotation from the hybrid networks printed on lower printed circuit board 21, the combined elemental array of FIG. 1 produces a circularly polarized signal with hemispheric coverage. This coverage profile is illustrated in FIG. 5 which shows the combined effect of the L-shaped stub arrangement of FIG. 1 fed in phase rotation as described above.

More particularly, curve A represents the radiation or sensitivity profile of a feed wire stub, providing broad beam hemispherical coverage in the form of a variation in one cycle of phase with asimuth and having a null at 0 and extending to the horizon H. Curve B represents the radiation or sensitivity profile of an equivalent crossed-dipole mode pattern resulting from the connection locations of the feed wires on the metallic film areas 11–14, being feed in phase rotation. Curve B has a maximum at point 0 and substantial sensitivity in the null or reduced region of curve A. The combined result is a modified pattern, namely the null region of curve A may be filled in along line C. By changing the geometrical location of contact holes 31–34 on elements 11–14, and the shape of the elements, the profile of the signal radiation/response characteristic of the array can be easily changed. For example, by moving the location at which the vertical feed wires contact each element to a location more geometrically centrally located on each element, thereby forming a T-shaped element, the antenna profile is altered towards a maximum signal sensitivity/strength in the horizontal plane and minimum at the zenith or nadir.

Figure 1A:
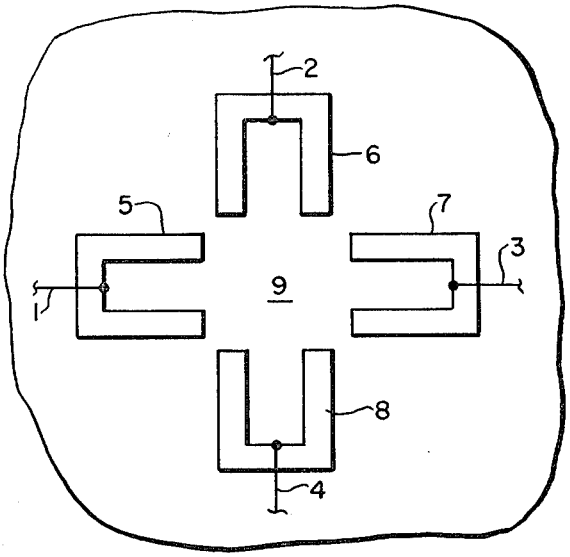
FIG. 1A depicts an arrangement of radiation elements in the form of unbalanced, U-shaped slots.

As mentioned previously, the individual radiation elements may take on various shapes, such as unbalanced and U-shaped slots, for example. FIG. 1A illustrates an array of four respective slots which are unbalanced and U-shaped. Each of slots 5, 6, 7 and 8 is comprised of a substantially U-shaped slot or cut-out in a metallic or conductive plain 9. Feed wires 1, 2, 3 and 4 may be coupled to an edge of the conductive plain opposite to the bottom of each of the respective U-shaped slots 5, 6, 7 and 8, as shown.

It should be observed that each antenna element individually does not exhibit the proper polarization characteristics (which in fact, change sense of circular polarization throughout the hemisphere). However, when combined in an array configuration, such as that described above, the cross-polarized components are cancelled to a large degree, and the desired sense of circular polarization is predominant over the entire hemisphere.

The four L-shaped elements 11–14 are doubly tuned impedance matched to operate over two frequency bands, and 90° and 180° hybrids are used to provide the proper phase of excitation over these two frequency ranges. These 90° and 180° hybrid feed networks are required for dual frequency operation, where the two frequencies of interest are separated by a significant amount, thereby ensuring a broadband feed network. Still, it is to be observed that a separate impedance matching network which doubly tunes the individual elements is the controlling factor for dual frequency operation. For narrow-band single frequency operation, a simple delay line may be employed as the impedance matching feed network. Thus, rather than use these hybrids, other signal coupling networks may be employed so as to provide the intended excitation to provide the desired antenna coverage profile. Also, the place of the L-shaped elements of FIG. 1, elements of different shapes and arrangements may be employed, such as those illustrated in FIGS. 2 and 3, to be described below.

Figure 2:
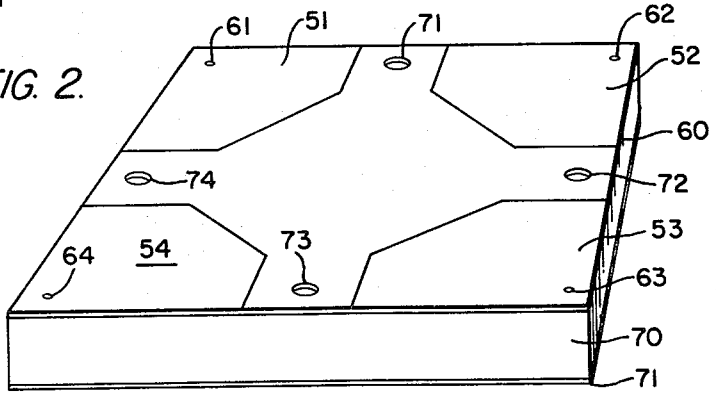
FIG. 2 depicts an embodiment of a four element circularly polarized hemispheric coverage antenna having asymmetrical top-loaded elements.

The antenna configuration shown in FIG. 2, like that of FIG. 1, contains an array of four antenna elements. In this embodiment, however, the array is formed of asymmetrical top-loaded elements 51–54 disposed at the corners of a top or upper printed circuit board 60. The antenna of FIG. 2 also includes a thin dielectric spacer 70 and a lower circuit board 71 containing suitable impedance matching/phasing networks, as described above. Again, where a doubly tuned impedance matched embodiment operating over two frequency bands is desired, the circuit on board 71 may consists of 90° and 180° hybrids. The upper and lower printed circuit boards and spacer are assembled together by suitable screws passing through holes 71–74 in each of the boards and spacer. The feed wires from the signal coupling network on lower printed circuit board 71 pass through spacer 70 and board 60 to be electrically connected to asymmetrical elements 51–54 at corner locations 61–64, as shown, so that the desired circularly polarized hemispherical coverage is provided from a four element array of asymmetrical top-loaded elements.

Figure 4:
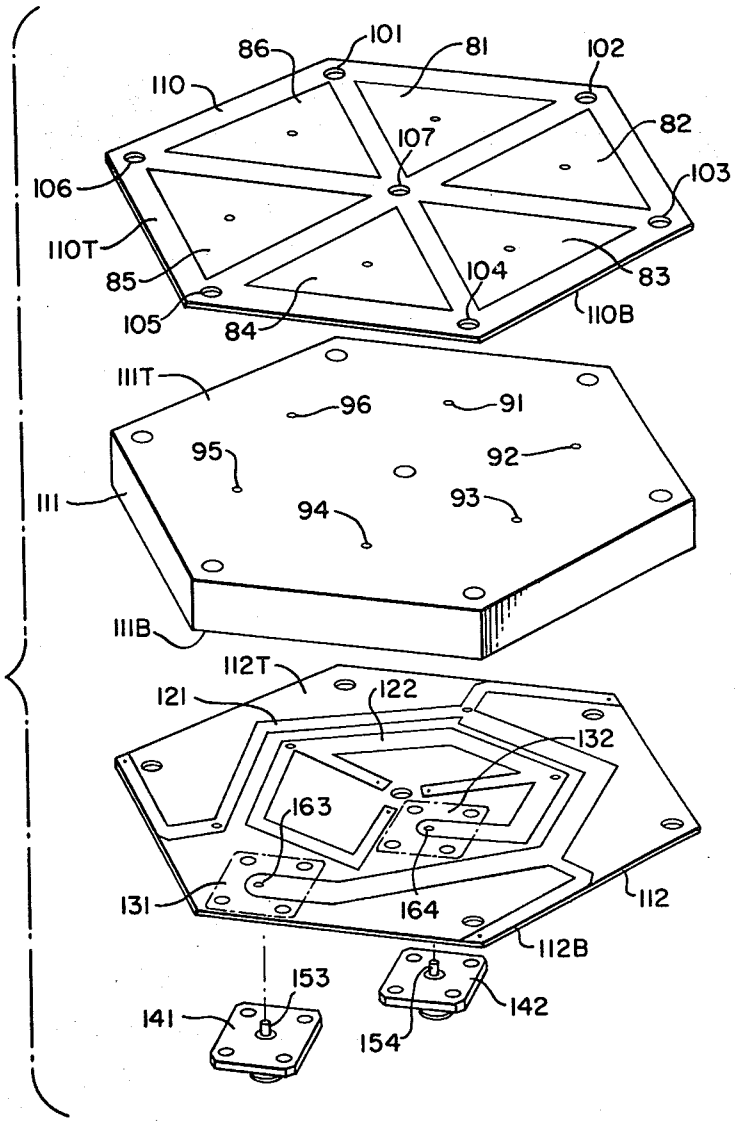
FIG. 4 is an exploded view of the antenna of FIG. 3.
Figure 3:
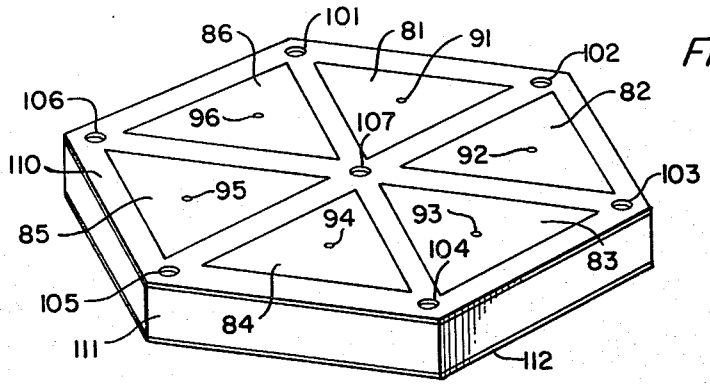
FIG. 3 depicts an embodiment of a circularly polarized hemispheric coverage antenna having three asymmetrical top-loaded elements for two operating frequencies.

A three element, two frequency embodiment of the invention utilizing three asymmetrical top-loaded elements at each operating frequency is shown in its assembled form in FIG. 3 and in the exploded view of FIG. 4. It should be noted that exploded views of the embodiments of FIGS. 1 and 2 have not been shown in order to simplify the drawings and description. The embodiment of FIG. 3 was chosen as an expedient to illustrate a version of the invention involving two sets of radiation elements, the simpler layouts of FIGS. 1 and 2 being readily apparent to one skilled in the art, especially having the benefit of the dual frequency version of FIG. 3.

Referring now to FIGS. 3 and 4, like the previously described embodiments of FIGS. 1 and 2, the three element array employs respective upper and lower printed circuit boards 110 and 112 between which a thin dielectric spacer 111 is sandwiched in the antenna's assembled configuration. The bottom 110B of board 110 rests on the top 111T of spacer 111, while the top 112T abuts against the bottom 111B of spacer 111. On the top or upper surface of board 110 there are disposed (e.g. plated or deposited) two sets of three triangular shaped (top loaded) antenna elements 81–86, through each of which extends a respective feed wire contact hole 91–96. The contact holes 91–96 extend through spacer 111 to points of projection for feed wires from the printed circuit impedance matching and phase delay network made up of sections 121 and 122 on surface 112T of printed circuit board 112. A plurality of holes 101–107 are futher provided in boards 110, 112 and spacer 111 for receiving connection screws for assembly of the antenna package. Finally at areas 131 and 132 on the bottom surface 112B of board 112 a pair of connectors 141 and 142 are fastened. Connector 141 has a coaxial feed center lead 153 for extending through board 112 to electrically contact network 121 at junction point 163. Similarly, connector 142 has a coaxial feed center lead 154 for extending through board 112 to electrically contact network 122 at junction point 164.

In lieu of connectors 141 and 142, however, a diplexer (with one connector) could be incorporated for electrical coupling to the lower printed circuit board 112.

As is the case with the embodiments of the invention shown in FIGS. 1 and 2, control of the shape of the antenna radiation/sensitivity profile is easily accomplished simply by locating the position of the feed wires from networks 121 and 122 to the points of contact on elements 81–86, so that the radio of zenith (or nadir) to horizon signal is controlled in all cases by the location of the vertical feed wire and the degree of imbalance of the radiation element on the printed circuit board.

As will be appreciated from the foregoing description of exemplary embodiments of the invention, the compact hemispherical coverage antenna of the present invention is particularly valuable for fixed (non-steerable) earth to satellite or aircraft communications where strong signal is required at elevation angles near the horizon because of the greater distance and transmission loss, yet the invention still provides coverage throughout an entire hemisphere. The thin profile or flush mounting structure offers low drag for high performance aircraft, and the printed circuit construction yields a rugged, light weight, low cost antenna.

While I have shown and described several embodiments in accordance with the present invention, it is understood that the same is not limited thereto but is susceptible to numerous changes and modifications as known to a person skilled in the art, and I therefore do not wish to be limited to the details shown and described herein but intend to cover all such changes and modifications as are obvious to one of ordinary skill in the art.

What is claimed is:

1. An antenna comprising:

a plurality of antenna elements spaced apart from each other; and an impedance matching and signal coupling network for feeding signals to said antenna elements in phase rotation; and wherein each of said antenna elements comprises a radiating feed wire stub and a thin radiating element, one end of said feed wire stub being connected to said network and the other end of said feed wire stub being connected to said thin radiating element such that the radiation coverage profile generated by said plurality of antenna elements provides broad beam hemispherical coverage in the form of a first component shaped as a variation in one cycle of phase with azimuth defined by said feed wire stubs and a second component corresponding to an equivalent crossed-dipole mode pattern by way of which the null in the stub contribution to the pattern is compensated.

2. An antenna according to claim 1, further comprising a thin layer of insulating material on opposite sides of which said thin radiating elements and said network are respectively disposed.

3. An antenna according to claim 2, wherein said thin radiating elements are formed of thin layers of conductive material disposed atop one side of said thin layer of insulating material and said wire stubs extend from said network through said thin layer of insulating material and contact said thin layers of conductive material.

4. An antenna according to claim 3, wherein said network is formed of a printed configuration disposed on the side of said thin layer of insulating material opposite to said one side thereof.

5. An antenna according to claim 4, wherein said impedance matching network comprises 90° and 180° hybrids, and said antenna is doubly tuned impedance matched over two frequency bands.

6. An antenna comprising:

a plurality of antenna elements spaced apart from each other; and means for feeding signals to said antenna elements in phase rotation; and wherein each of said antenna elements comprises a slot-shaped radiating element formed in a layer of conductive material and a metallic radiating element coupled with said slot-shaped element and being connected to said signal feeding means such that the radiation coverage profile generated by said plurality of antenna elements provides broad beam hemispherical coverage in the form of a first component shaped as a variation in one cycle of phase with azimuth defined by said slot-shaped radiating elements, and a second component corresponding to an equivalent crossed-dipole mode pattern, defined by said metallic radiating elements by way of which a null in the first component of the pattern contributed by said slot-shaped elements is compensated.

7. An antenna according to claim 6, further comprising a thin layer of insulating material on opposite sides of which said antenna elements and said feeding means are respectively disposed.

8. An antenna comprising:

a plurality of antenna elements spaced apart from each other; and means for feeding signals to said antenna elements in phase rotation; and wherein each of said antenna elements comprises a first type of radiating element and a second type of radiating element coupled with said first type of radiating element and connected to said signal feeding means such that the radiation coverage profile generated by said plurality of antenna elements provides broad beam hemispherical coverage in the form of a first component shaped as a variation in one cycle of phase with azimuth defined by said first type of radiation elements, and a second component corresponding to an equivalent cross-dipole mode pattern, defined by said second type of antenna elements by way of which a null in the first component of the pattern contributed by said first type of elements is compensated.

9. An antenna according to claim 8, further comprising a thin layer of insulating material on opposite sides of which at least one of said first and second types of radiating elements and said feeding means are respectively disposed.

10. An antenna according to claim 9, wherein said feeding means is formed of a printed circuit configuration.

11. An antenna according to claim 9, wherein said antenna elements are configured as unbalanced slots formed in a layer of conductive material.

12. An antenna according to claim 9, wherein said first type of radiating elements are configured as U-shaped slots formed in a layer of conductive material.

13. An antenna according to claim 8, wherein each of said antenna elements is comprised of one of L-shaped stubs, U-shaped slots, asymmetrically top-loaded stubs and unbalanced slots, said slots being formed in a layer of conductive material.

14. An antenna according to claim 9, wherein said feeding means comprises 90° and 180° hybrids, and wherein said antenna is doubly tuned impedance matched over two frequency bands.

* * * * *